US006112442A

United States Patent [19]

Liang

[11] Patent Number: 6,112,442

[45] Date of Patent: Sep. 5, 2000

[54] STRUCTURE OF A GIFT BOX WITH AMAZING EFFECTS

[76] Inventor: Dennis Liang, P.O. Box 82-144, Taipie, Taiwan

[21] Appl. No.: 09/189,999

[22] Filed: Nov. 12, 1998

[51] Int. Cl.[7] ..... G09F 19/00

[52] U.S. Cl. ..... 40/436; 206/525; 220/523

[58] Field of Search ..... 40/436; 206/774, 206/804, 525; 220/523; 446/310; D9/414, 418, 420

[56] References Cited

U.S. PATENT DOCUMENTS 333,123 12/1885 Goldsmith .
1,661,728 3/1928 Rue .
1,827,929 10/1931 Bigelow .
2,584,435 2/1952 Doerr .
2,989,221 6/1961 Butler .
5,558,214 9/1996 Brundidge .

*Primary Examiner*—Terry Lee Melius
*Assistant Examiner*—William L. Miller
*Attorney, Agent, or Firm*—A & J

[57] ABSTRACT

A gift box includes a housing with a lid, the housing having a top formed with an opening, a decoration container arranged within the housing, a decoration fitted inside the decoration container, a curtain mounted on the decoration container, and means for opening the curtain and moving up the decoration to go through the opening, whereby a flower will rise from the decoration container, and a music will be produced through a loudspeak when the keyboard is operated as instructed by the information shown in the display, thereby making the receiver feel the deep sincerity of the sender.

8 Claims, 14 Drawing Sheets

STRUCTURE OF A GIFT BOX WITH AMAZING EFFECTS

BACKGROUND OF THE INVENTION

1. Field of the Invention

This invention is related to the structure of a gift box with amazing effects.

2. Description of the Prior Art

Gift is something given to show friendship, affection, support . . . etc and the most common gifts are flower and greeting cards. However, such gifts are static in condition and do not provide video and audio effects thereby making it difficult to attract the receiver. Hence, it has been proposed to give a music box as a gift, but the music box can produce only one tune when the box is opened hence making it dull and monotonous.

Therefore, it is an object of the present invention to provide a structure of gift box with amazing effects thereby obviating and mitigating the above-mentioned drawbacks.

SUMMARY OF THE INVENTION

This invention is related to the structure of a gift box with amazing effects.

According to a preferred embodiment of the present invention, a gift box includes a housing with a lid, the housing having a top formed with an opening, a decoration container arranged within the housing, a decoration fitted inside the decoration container, a curtain mounted on the decoration container, and means for opening the curtain and moving up the decoration to go through the opening.

It is the primary object of the present invention to provide a structure of a gift box with amazing effects which can make the receiver feel the deep sincerity of the sender.

It is another object of the present invention to provide a structure of a gift box with amazing effects which is unique and novel.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
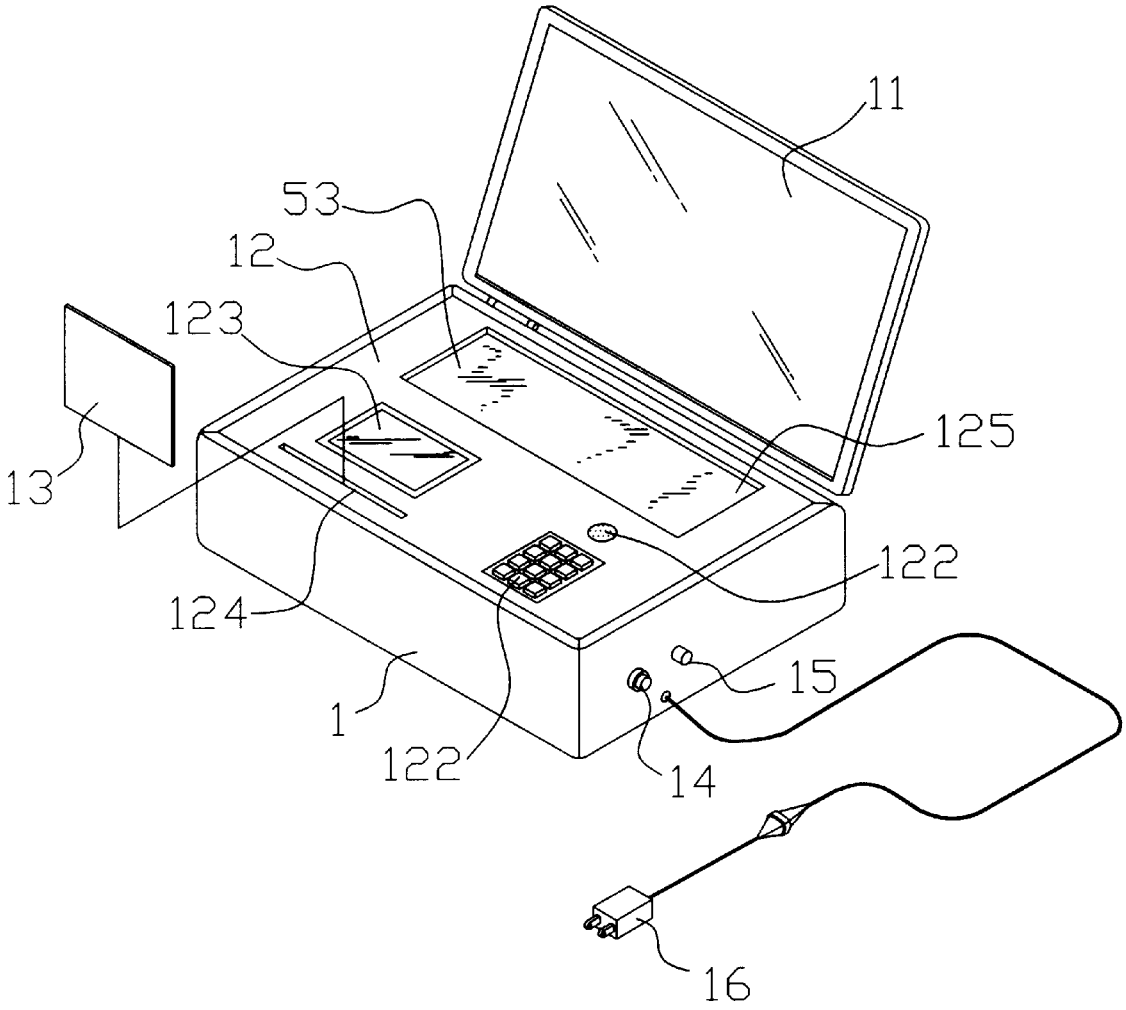
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
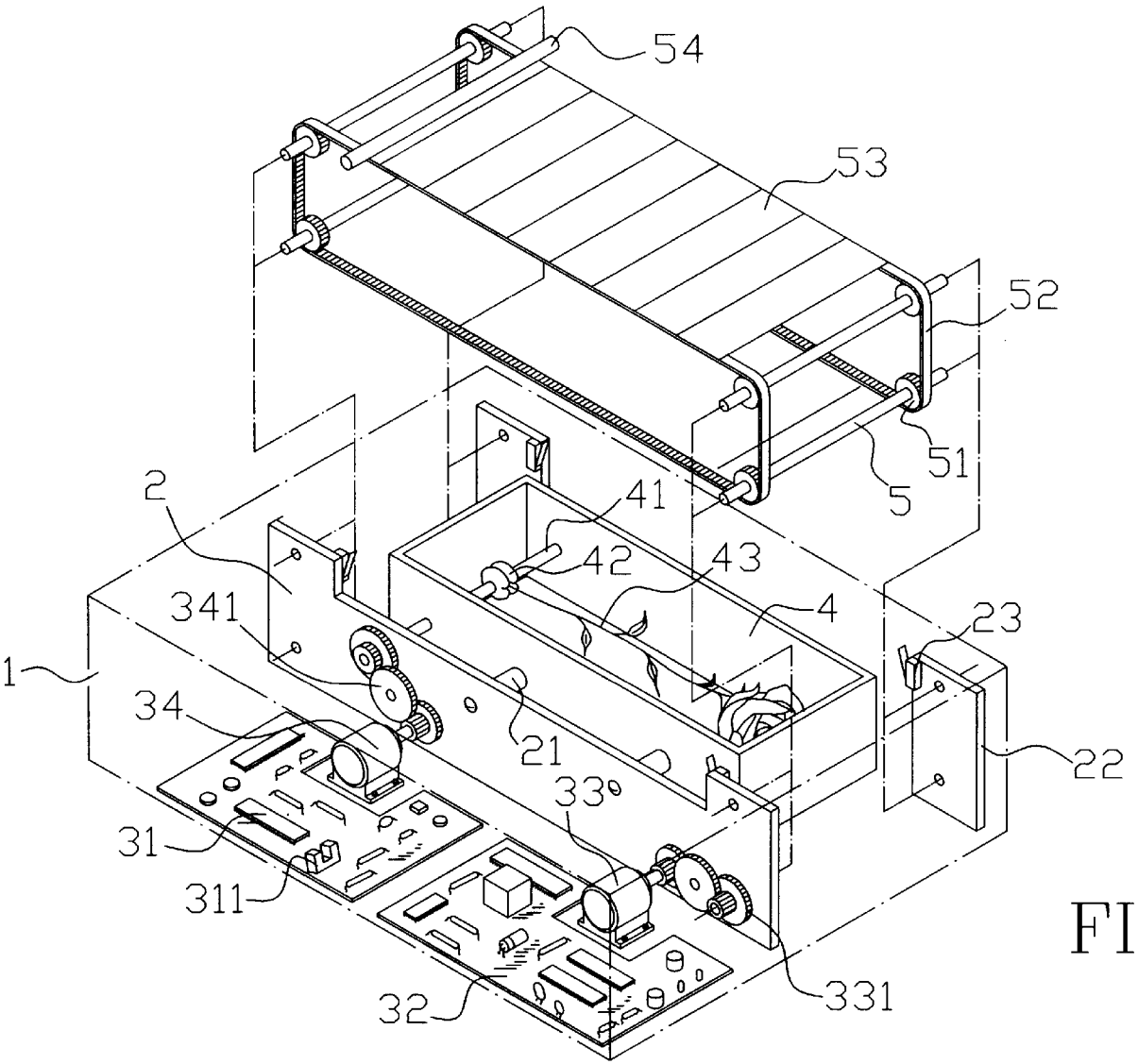
FIG. 2 is an exploded view of the present invention.
Figures 3, 3A:
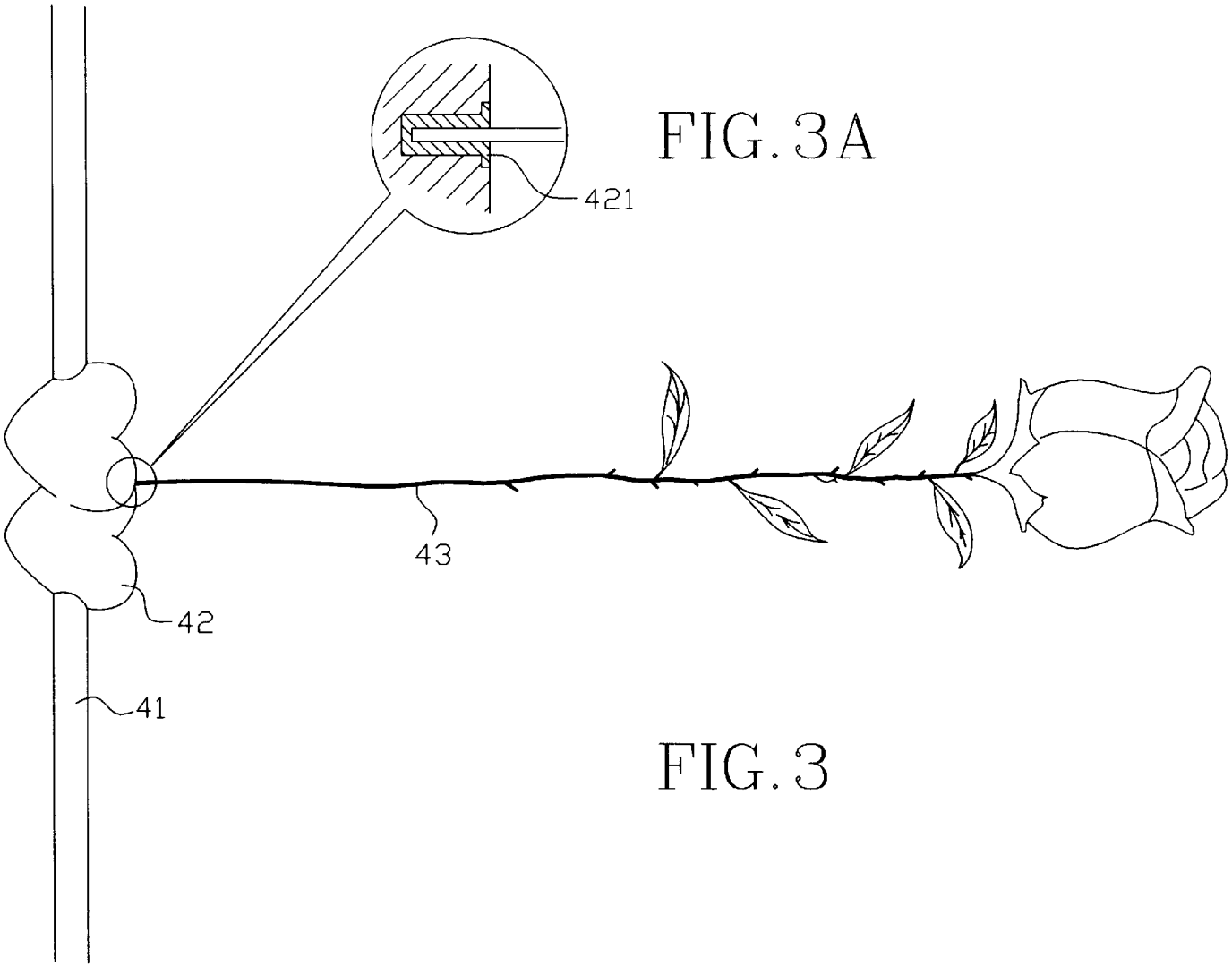
FIG. 3 is an enlarged view of the flower.
FIG. 3A illustrates the structure of the sleeve.
Figure 4:
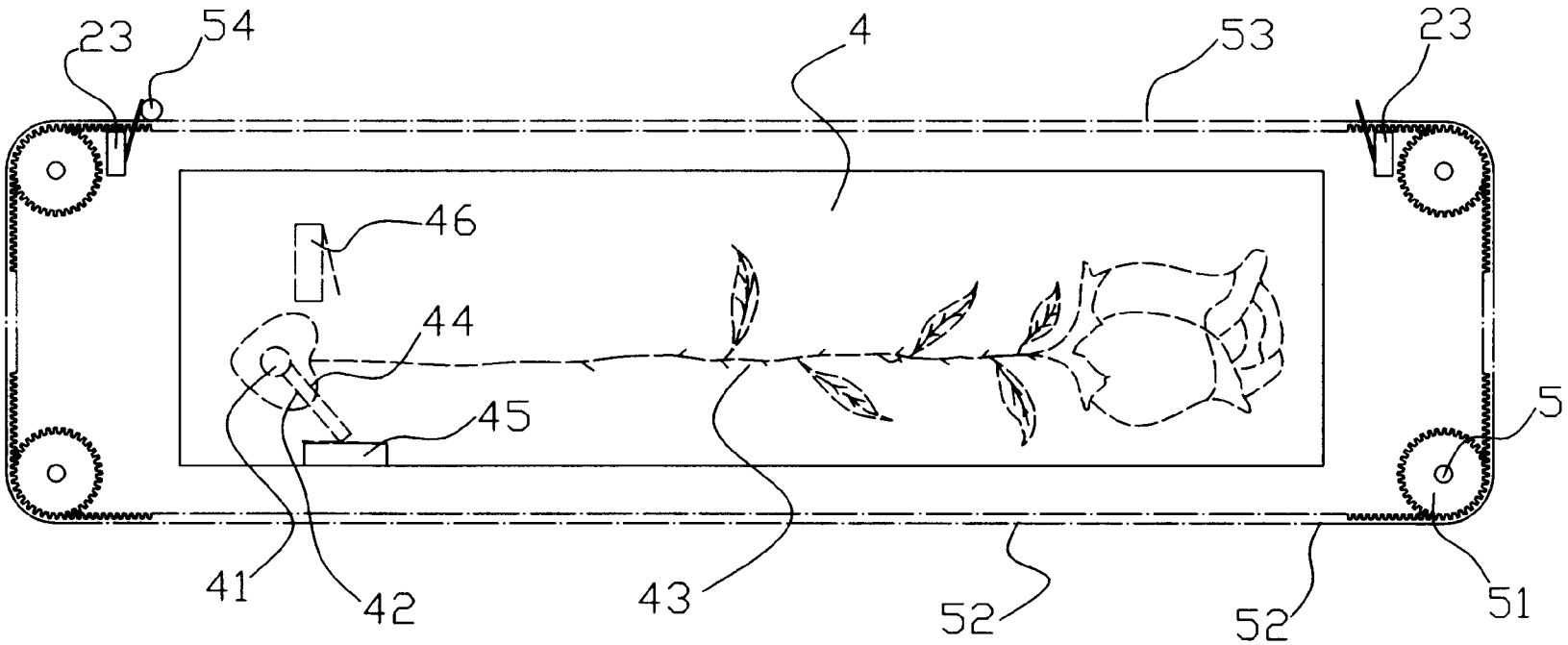
FIGS. 4 and 5 illustrate how the flower is moved up to a vertical position.

With reference to the drawings and in particular to FIGS. 1 and 2 thereof, the present invention generally comprises a rectangular housing 1 and a lid 11 pivotally connected an edge of the rectangular housing 1. The rectangular housing 1 is provided with a panel 12 on which are mounted a plurality of pushbuttons 121, a loudspeaker 122, a LCD (liquid crystal display) screen 123, an elongated slot 124, and an elongated opening 125. The pushbuttons 121 are used for setting programs, opening codes and various kinds of music, the loudspeaker 121 for producing music, the LCD screen 123 for showing operation procedures, the elongated slot 124 for the insertion of a thin card 13, and the elongated opening 125 for the passage of the gift in the rectangular housing 1. On one vertical side of the rectangular housing 1 are mounted a power switch 14, a brightness adjusting knob 15 and a plug 16.

The rectangular housing 1 is divided into two chambers by a partition 2 so that two printed circuit boards 31 and 32 are disposed within one of the chambers while a decoration container 4 is suspended within the other one of the chambers by two bolts 21. Four axles 51 are rotatably fitted between two ends of the partition 2 and two fixing plates 22. On Each of the axles 51 is fixedly mounted a gear 51. Two belts 52 are engaged with the gears 51, on which is mounted a curtain 53, so that when the gears 51 are rotated, the curtain 51 will be moved therewith. The axle 5 is driven by a first motor 33 through a gear train 33. The partition 2 are provided with a micro-switch at two ends thereof, while the fixing plates 22 has a micro-switch 23 at the inner top corner, so that when the curtain 53 is moved on the decoration container 4, a pushrod 54 installed on one edge of the curtain 53 will push the micro-switches 23 thereby controlling the curtain 53 to open or close as desired.

A second motor is provided for rotating the curtain 53 to move in a reverse direction. However, such means is well known in the art and not considered a part of the invention.

Figure 15:
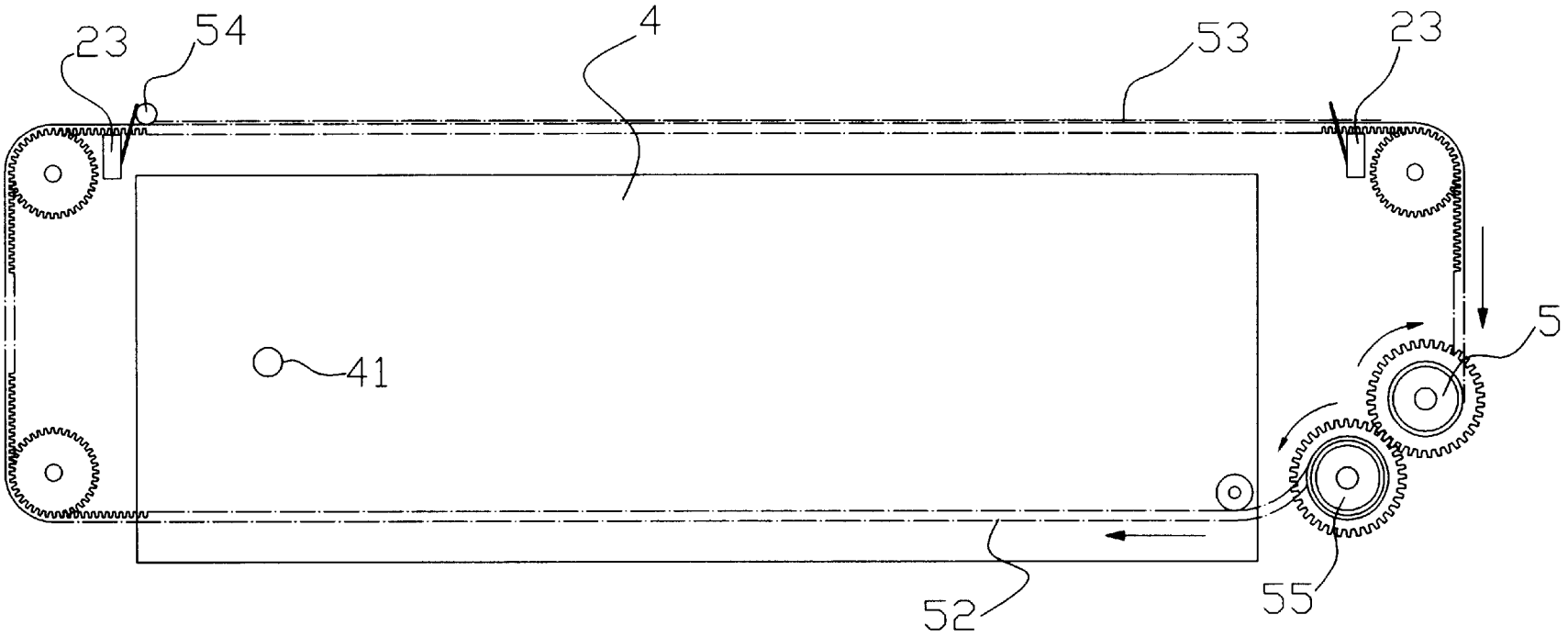
FIG. 15 illustrates another driving mechanism for opening the curtain.

FIG. 15 illustrates another preferred embodiment of the curtain 53. As shown, when the axle 5 is driven by the first motor, the shaft 55 will be driven too. As an end of the belt 52 is wound on the axle 5 and another end of the belt is wound on the shaft 55, the curtain 53 will be opened or closed when the first motor is turned on.

Referring to FIGS. 2, 3, 3A and 4, the decoration container 4 has an axle 41 on which is mounted a receptacle 42 provided with a resilient sleeve 421, so that the lower end of a flower 43 or the like can be fitted in the elastic sleeve 421. Normally, the flower 43 lies flat inside the decoration container 4. The axle 41 is connected to a second motor 34 through a gear train 341, so that the second motor 34 can drive the flower 34 to move to a vertical position. Another end of the axle 41 has a rod 44 which, when rotated, will contact the microswitches 45 and 46 thereby stopping the flower 43.

Figure 5:
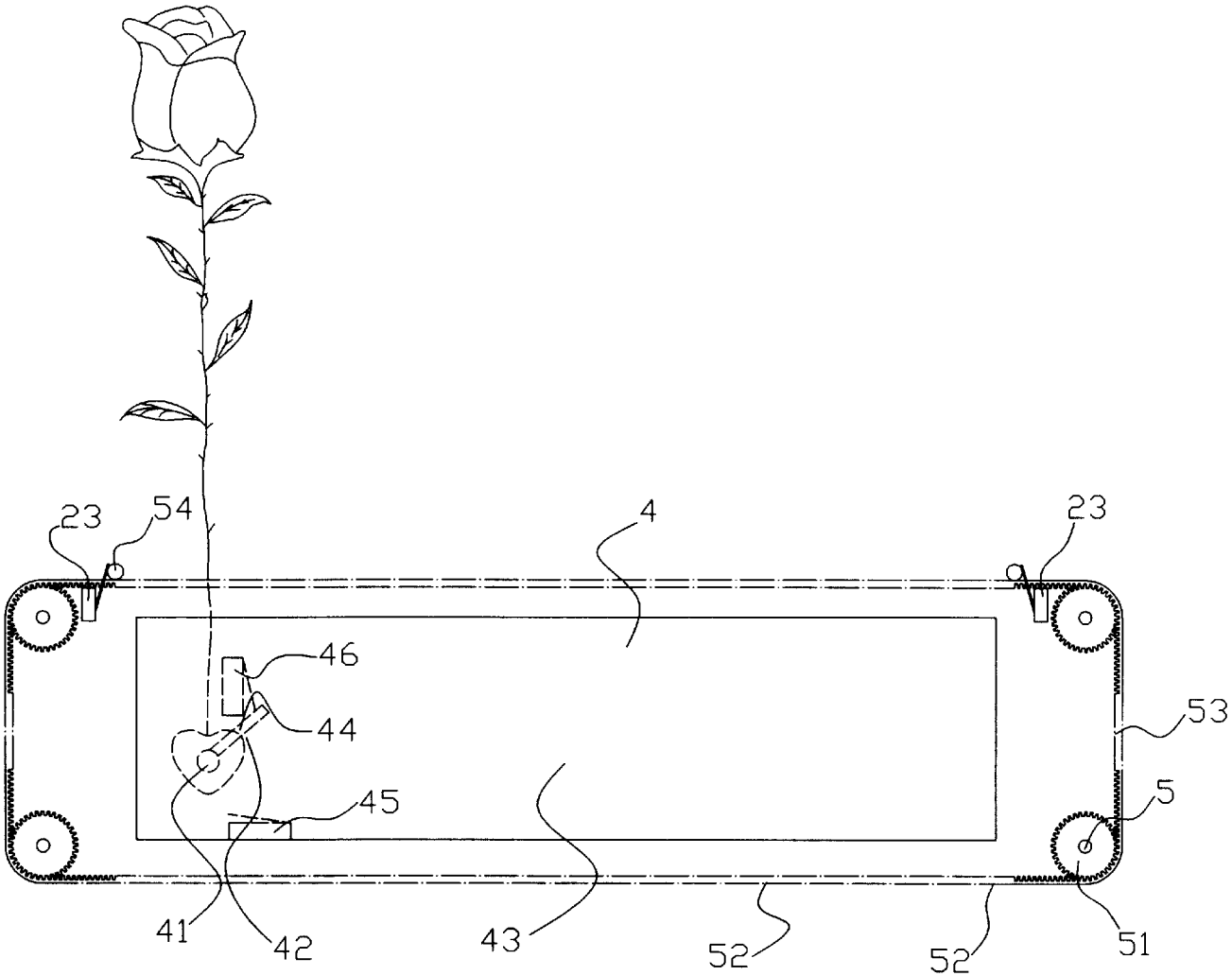
Figure 9:
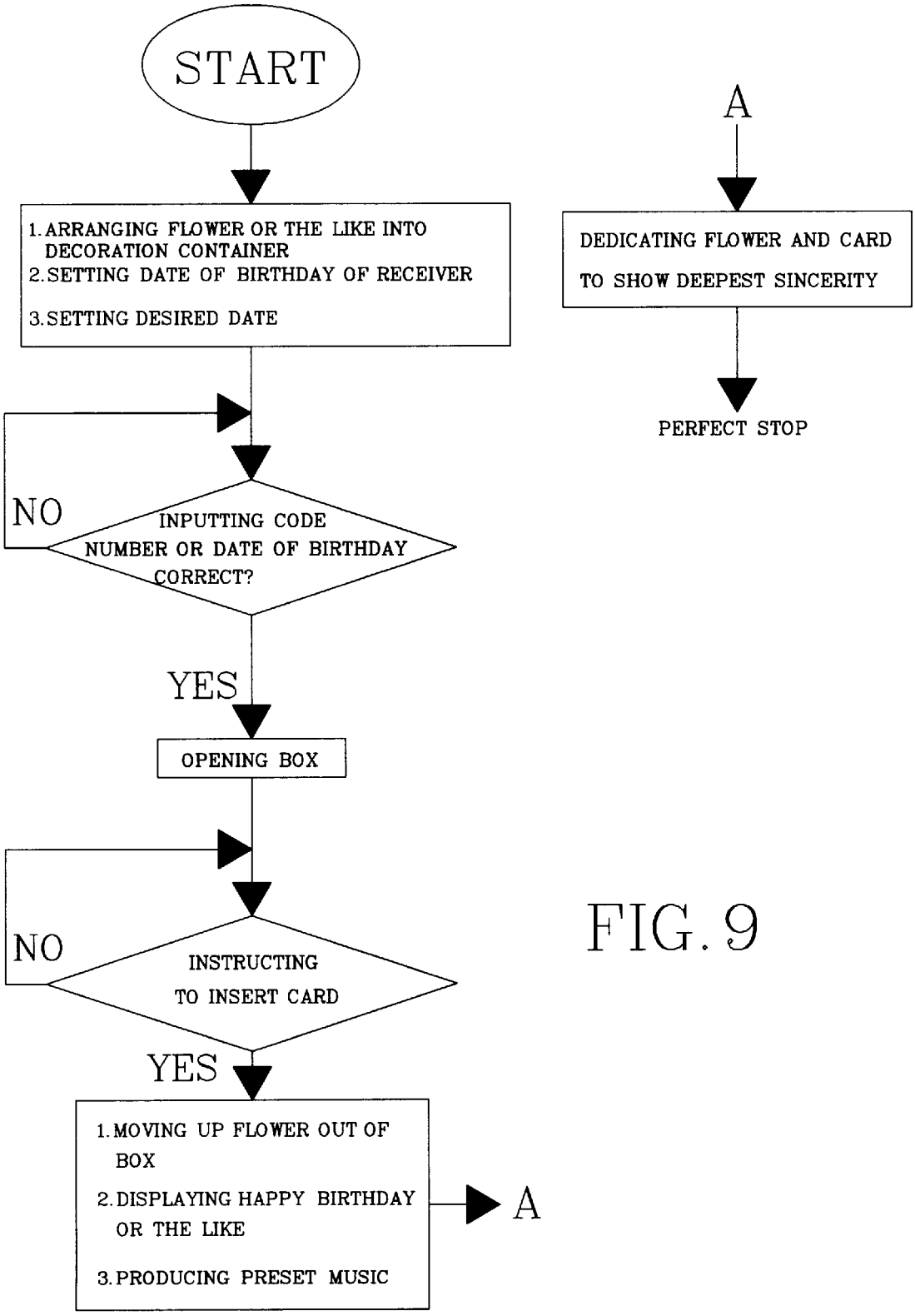
FIG. 9 is a first preferred flow chart of the present invention.

Referring to FIGS. 1, 2 and 9, when in use, one may use the keyboard 121 of the LCD screen 123 to set the date of birthday of the receiver or opening code number and birthday songs and Christmas songs in advance. Then, the receiver receives the present invention, he or she must key in the date of his or her birthday or code number. If the date of his or her birthday or code number is correct, the control circuit will turn on the first motor 33 which in turn moves the curtain 53 (see FIGS. 4 and 5). As the pushrod 54 is in contact with the microswitch 23, the curtain 53 will stop moving thereby opening the curtain 53 and therefore showing the flower 43. In the meantime, the LCD screen 123 shows the information which requests the receiver to insert a card 13 into the slot 124. As the card 13 is inserted into the slot 124, a sensor switch 311 will be turned on thus driving the control circuit and the music circuit. Then, the second motor 34 rotates the axle 41 to move up the flower 43 to a vertical position (see FIG. 5). Thereafter, the LCD screen 123 shows the wordings "Happy Birthday", "Merry Christmas", "Happy Valentine's Day . . . ", "Happy Forever". . . etc. and the loudspeaker 122 produces preset music thereby providing amazing video and audio effects simultaneously.

Figure 6:
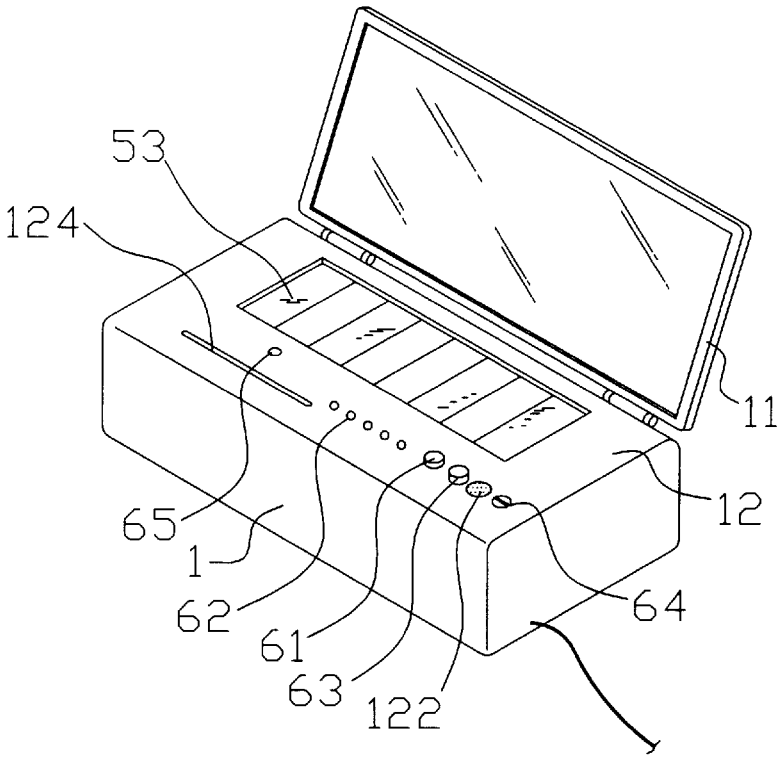
FIG. 6 is a perspective view of a second preferred embodiment of the present invention.
Figure 10:
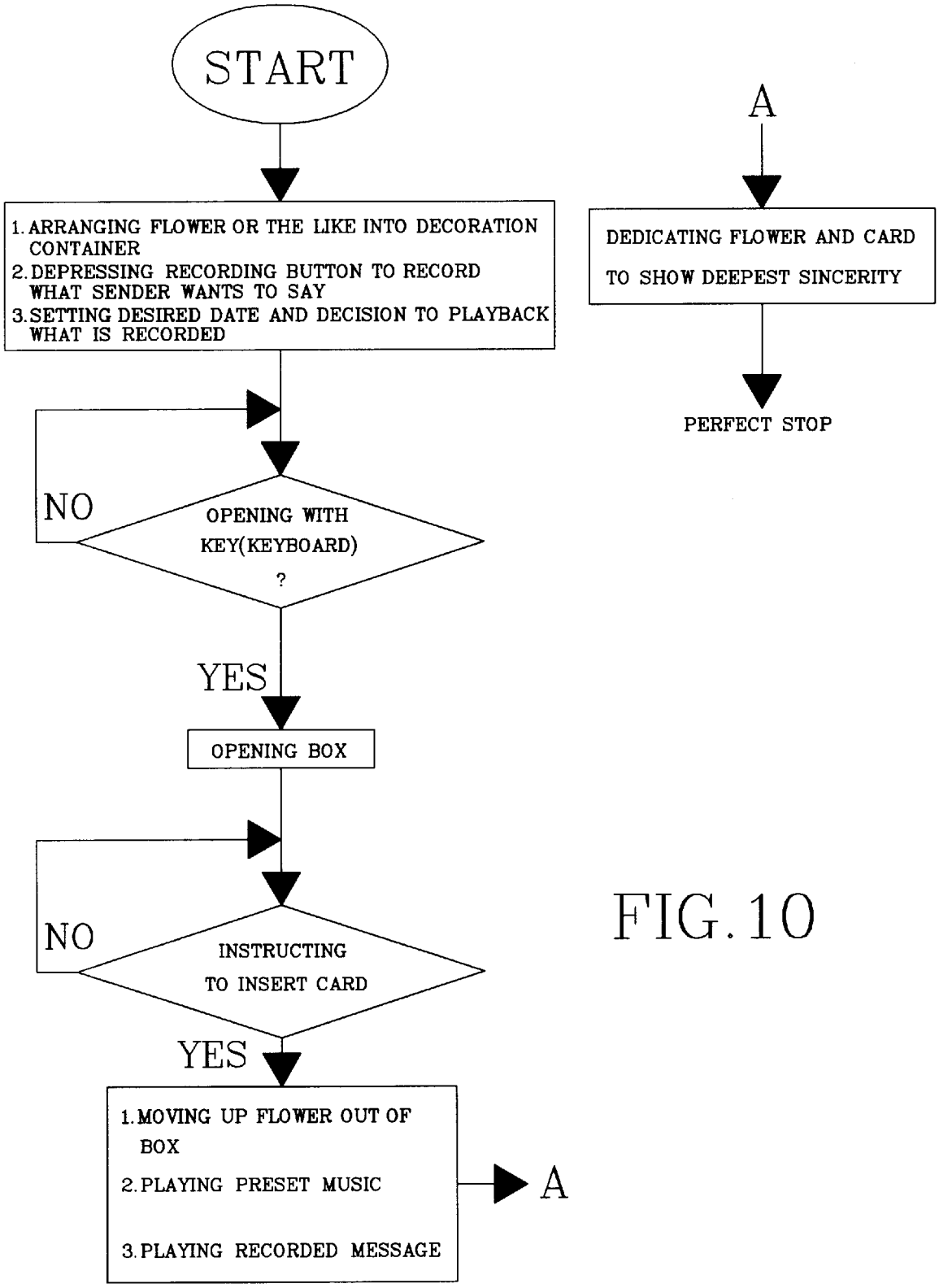
FIG. 10 is a second preferred flow chart of the present invention.

FIGS. 6 and 10 illustrate a second preferred embodiment of the present invention. As shown, the panel 12 is simplified so that the LCD display and the pushbuttons are replaced with music selecting button 61 and a plurality of indicating lights 62. The indicating lights 62 are used for indicating the music type for a special day such as birthday, Christmas . . . etc and playing back recorded messages. One may also use the recording button 63 to record what he or she wants, so that one may use the music selecting button 62 to choose the music that one would like to reproduce or playback the message that is previously recorded. In addition, there is a key switch 64 on the panel 64 so that the receiver may use a key to turn on the control circuit in order to open the curtain 53. Then, a indicating light 65 close to the slot 124 will flash to request the receiver to insert a card 13 into the slot 124. As the card 13 is inserted into the slot 124, the flower will be moved up to a vertical position and the preset music or the recording message will be playbacked. Such a structure will be easier to operate and lower in cost.

Figure 7:
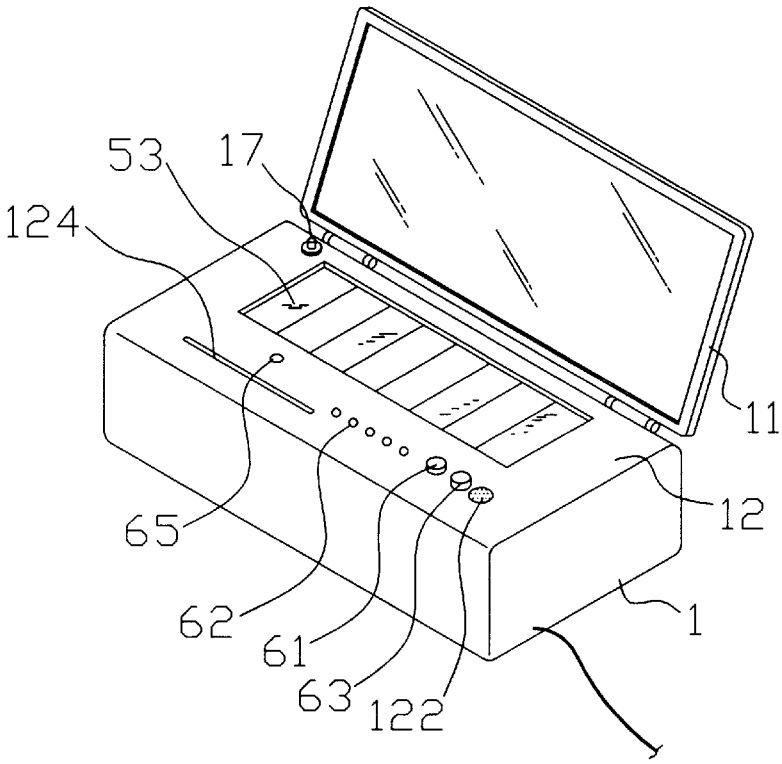
FIG. 7 is a perspective view of a third preferred embodiment of the present invention.
Figure 11:
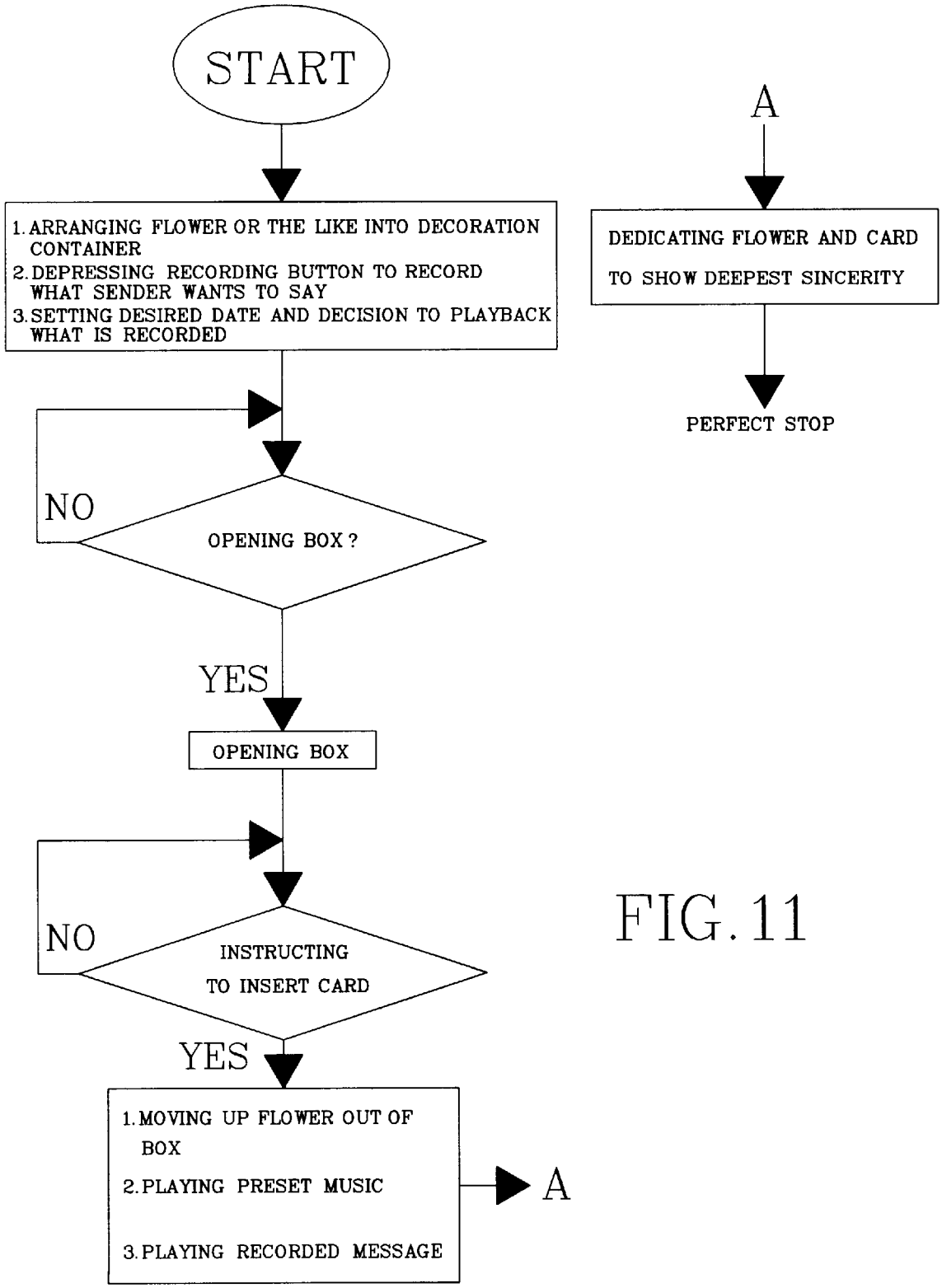
FIG. 11 is a third preferred flow chart of the present invention.

FIGS. 7 and 11 illustrate a third preferred embodiment of the panel 12. As illustrated, an auto switch 17 is mounted on the panel 12 so that when the receiver opens the lid 11, the first motor will be automatically turned on to open the curtain. Then, when the card is inserted into the slot 124, the flower will be moved up to a vertical position and the preset music will be playbacked.

Figure 8:
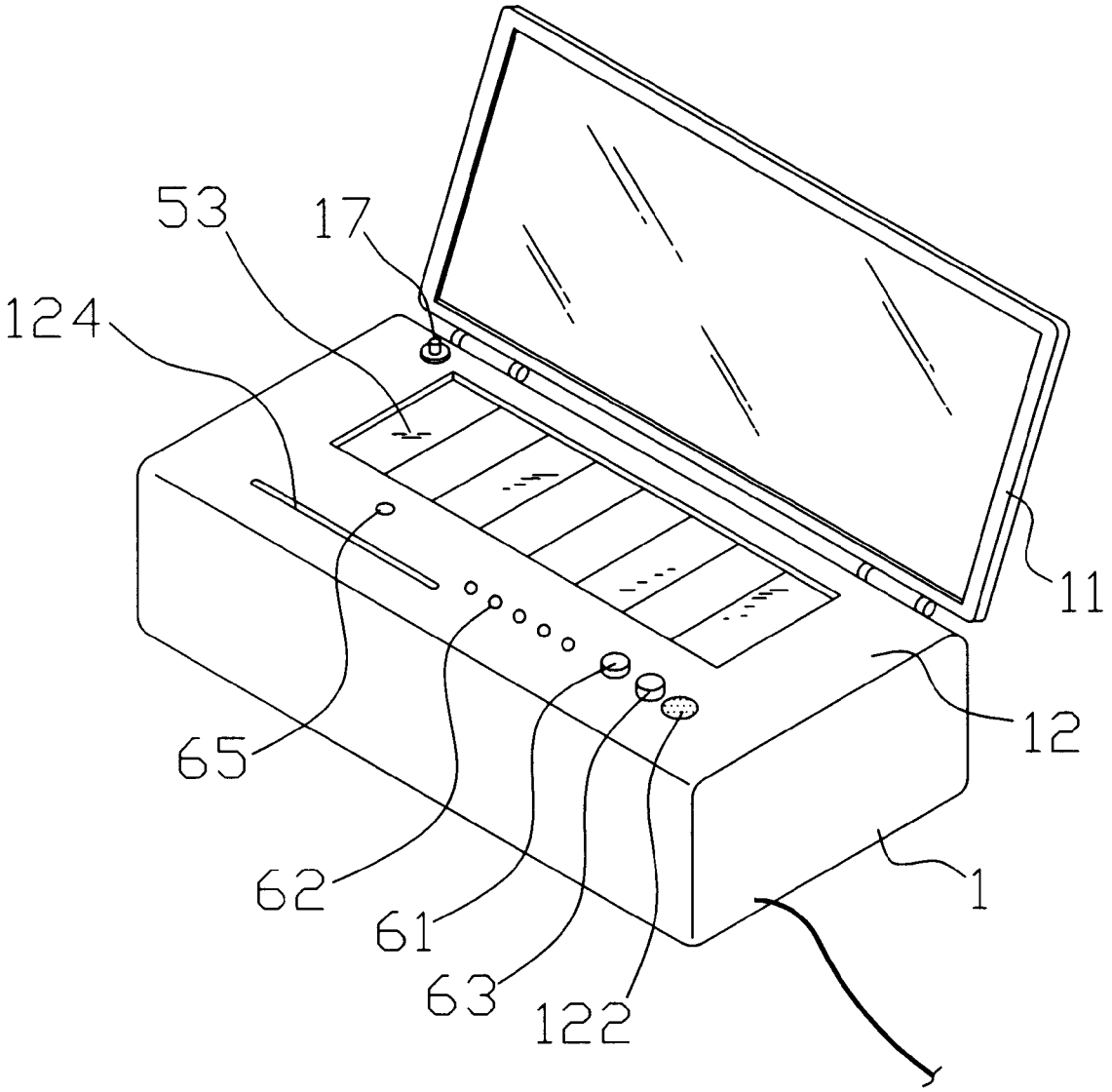
FIG. 8 is a perspective view of a fourth preferred embodiment of the present invention.
Figure 12:
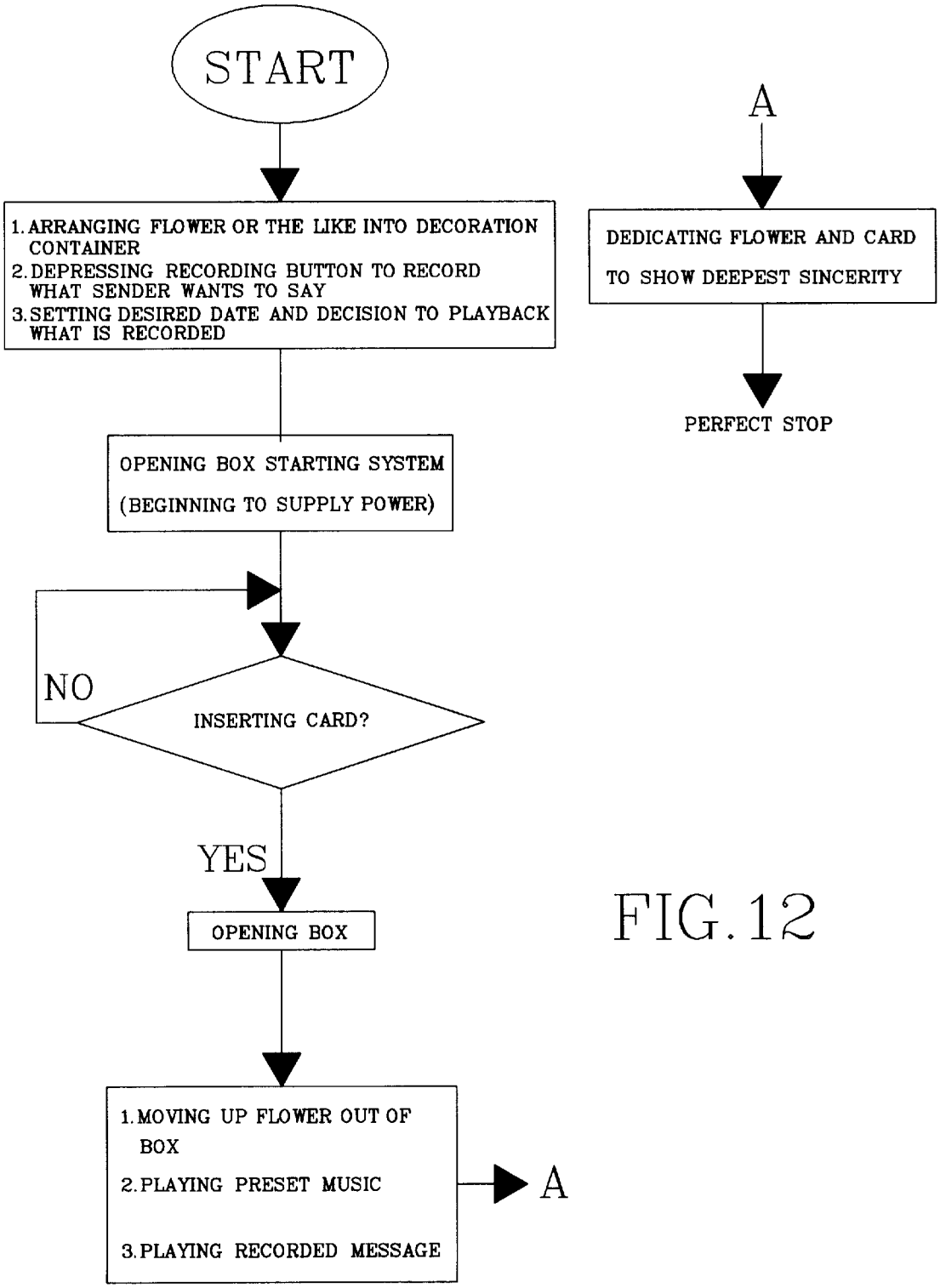
FIG. 12 is a fourth preferred flow chart of the present invention.

FIG. 8 and 12 illustrates another working procedures and operation of the panel 12. As shown, the panel 12 is provided with an auto switch 17 so that when the receiver opens the lid 11, the system will be started and the indicating light 65 will be turned on to request the receiver to insert the card into the slot. Then, the curtain 53 is opened and the flower is moved up to a vertical position and the preset music or the recording message is playbacked.

Figure 13:
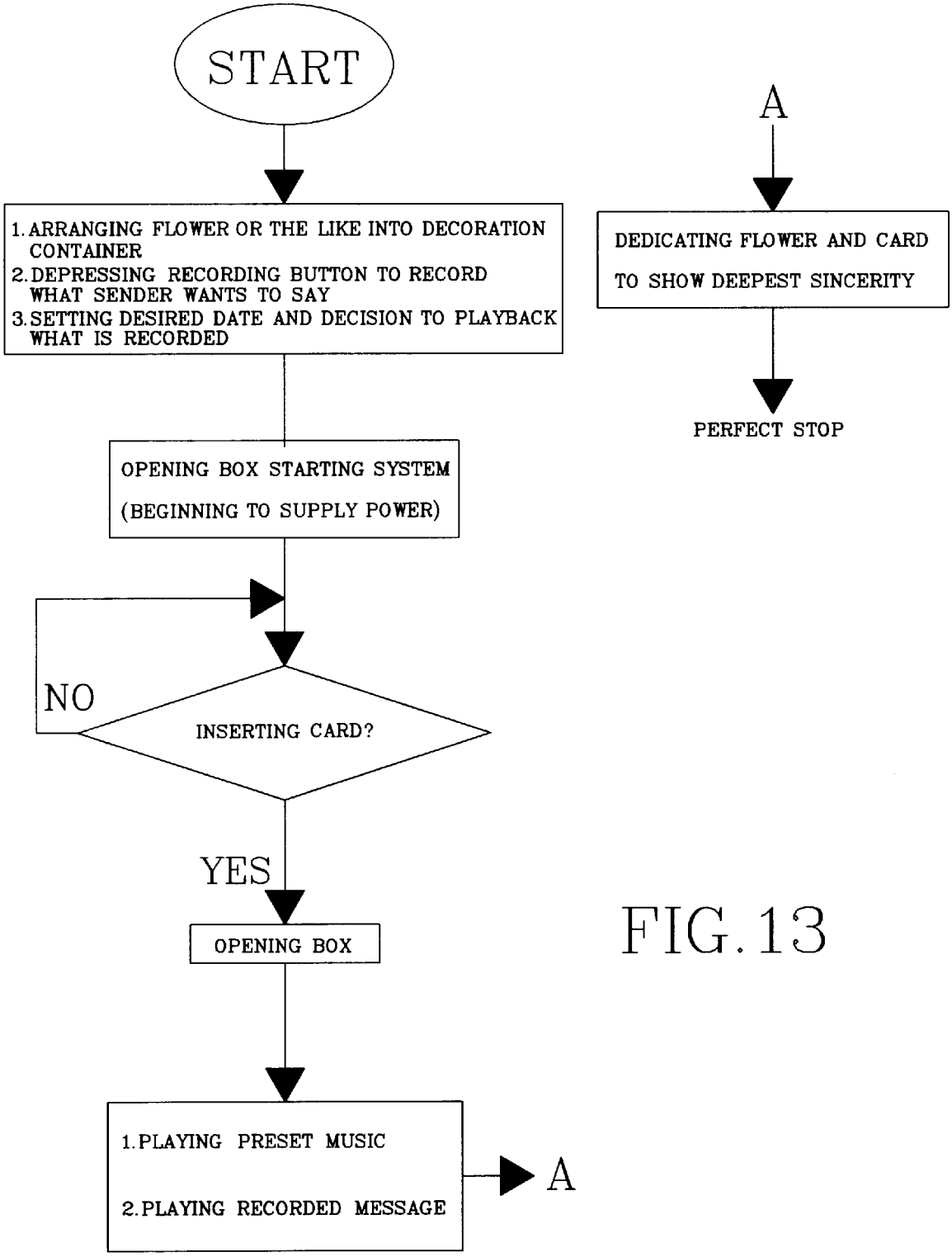
FIG. 13 is a fifth preferred flow chart of the present invention.

FIG. 13 illustrates another working procedures of the panel 12. As shown, when the lid 11 is opened, the auto switch 17 will start the system and the indicating light 65 will be turned on to request the receiver to insert the card into the slot thereby opening the curtain and playing back the preset music or the recording message.

Figure 14:
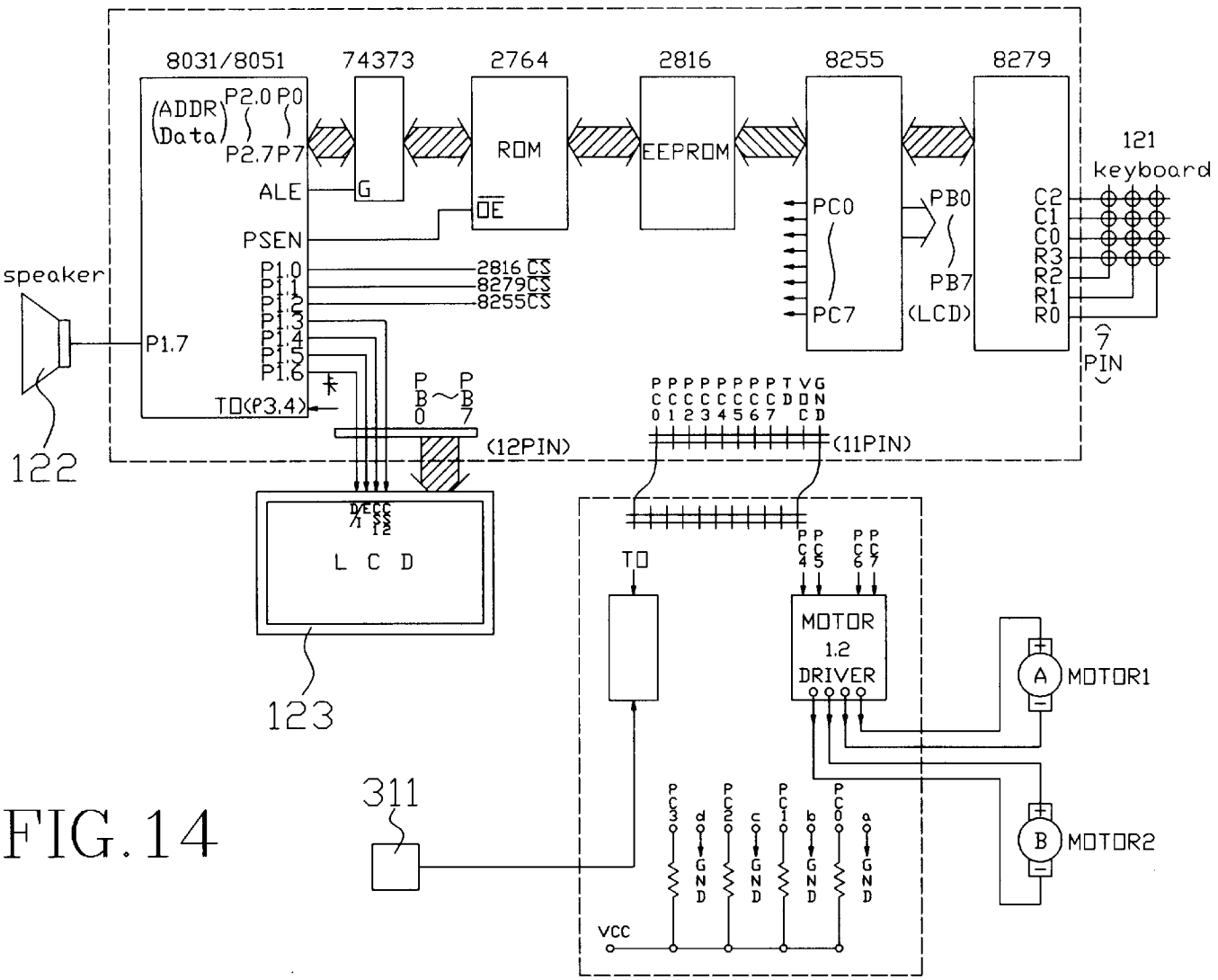
FIG. 14 is a block diagram of the control circuit of the present invention.

FIG. 14 illustrates the block diagram of the control circuit present invention, wherein:

1. 8501 is a 8-bit single chip microprocessor characterizes as follows:

a. 4KX8 ROM b. 128X8 RAM c. four 8-bit ports d. four 16-bit timer/counter e. two external interrupters;

f. high performance dualplex series passage;

e. capable of externally expanded to 128K bytes g. processor.

The port PO of 8051 single chip microprocessor is a two-way port for direct read/write operation to external memory, and may output 8-bit address which is locked by an external locking device (74LS373). ALE is used for locking signal.

Port P1: for selecting chip and controlling signal of LCD in this circuit;

Port P2: for selecting signal for 8-bit address;

Port p3: for controlling signal of external chip; and

3.O (RXD) Pin: for receiving signal from photo sensor so as to detect whether the card has been inserted or not.

2. 2764 is an EPROM used as an external read only memory chip for the single chip processor and for storing execution programs.

3. 2816 is an EEPROM which is a memory chip tha holds its content without power and used for storing code number, songs . . . etc.

4. 8255 is a programmable peripheral interface chip having three output ports A, B and C wherein port B is used as a bus for LCD data, and port C for detecting switching signals. PC4 and PC5 are used for controlling the box and PC6 and PC7 for controlling the flower to move up to a vertical position.

5. 8279 is a programmable keyboard and display interface for controlling input of the keyboard and pickup by 8051.

6. LCD (DG-12864) is a graphic liquid crystal display which can get information from 8051 and show out in the display.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A gift box comprising:

a housing with a lid, said housing having a top provided with a panel formed with an opening;

a decoration container arranged within said housing;

a decoration fitted inside said decoration container;

a curtain mounted on said decoration container wherein said curtain closes said opening; and means for opening said curtain and moving up said decoration to go through said opening.

2. The gift box as claimed in claim 1, wherein said panel is provided with a plurality of pushbuttons, a loudspeaker, a LCD screen, an elongated slot and an elongated opening for receiving said LCD screen.

3. The gift box as claimed in claim 1, wherein said decoration container is suspended within said housing and has an axle on which is mounted a socket with a resilient sleeve for holding said decoration.

4. The gift box as claimed in claim 3, wherein said axle is provided with a rod and two microswitches one arranged above said rod and another under said rod.

5. The gift box as claimed in claim 1, further comprising a partition in said housing provided with two microswitches at two ends thereof, two fixed plates fixedly mounted in said housing, four axles rotatably fitted between two ends of said partition and said two fixing plates, each of said axles being provided with a gear, two belts engaged with said gears, and said curtain mounted on said belts.

6. The gift box as claimed in claim 5, wherein said curtain is driven by a first motor to roll up and by a second motor to roll out.

7. The gift box as claimed in claim 1, wherein said panel is provided with a button for setting music, a plurality of indicating lights, a key switch, a recording button and a card indicator.

8. The gift box as claimed in claim 1, wherein said panel is provided with a button for setting music, a plurality of indicating lights, a card indicator and an auto switch.

* * * * *